United States Patent [19]

Fries

[11] 4,043,592

[45] Aug. 23, 1977

[54] ADJUSTABLE SEAT BACK MECHANISM

[75] Inventor: Bernard J. Fries, Jenison, Mich.

[73] Assignee: Steelcase Inc., Grand Rapids, Mich.

[21] Appl. No.: 610,832

[22] Filed: Sept. 5, 1975

[51] Int. Cl.[2] ..... A47C 3/00

[52] U.S. Cl. ..... 297/291; 297/306; 297/354

[58] Field of Search ..... 297/354, 298, 309, 291, 297/292, 296, 297, 300, 285, 306, 355; 292/274, 270; 248/407, 408

[56] References Cited

U.S. PATENT DOCUMENTS

| | | | |
|---|---|---|---|
| 1,816,486 | 7/1931 | Johnson | 297/292 |
| 2,524,624 | 10/1950 | Cramer | 297/291 |
| 2,599,301 | 6/1952 | Van Buren | 297/306 |
| 2,692,012 | 10/1954 | Cramer | 297/298 |
| 3,295,888 | 1/1967 | Poland | 297/298 |

FOREIGN PATENT DOCUMENTS

| | | | |
|---|---|---|---|
| 581,287 | 7/1933 | Germany | 292/270 |
| 565,820 | 11/1944 | United Kingdom | 248/408 |
| 490,735 | 8/1938 | United Kingdom | 297/291 |

*Primary Examiner*—Roy D. Frazier
*Assistant Examiner*—Darrell Marquette
*Attorney, Agent, or Firm*—Price, Heneveld, Huizenga & Cooper

[57] ABSTRACT

An adjustable seat back mechanism for a chair of the type such as a secretarial posture chair which includes a vertical support to which a seat back is slidably mounted. The seat back mechanism includes a channel shaped support plate secured to the seat back of the chair, a housing and a latching arrangement carried by the housing for permitting stepwise vertical adjustment of the housing and support plate relative to the vertical support post of the chair. A pivotal connection between a housing and the support plate is accomplished by a resilient arrangement. In one embodiment, the resilient arrangement takes the form of a pair of rubber-like blocks. In an alternative embodiment, the resilient arrangement takes the form of a leaf spring and plate disposed between the housing and support plate. The spring plate, support plate and housing are interconnected by a pin.

21 Claims, 9 Drawing Figures

ADJUSTABLE SEAT BACK MECHANISM

BACKGROUND OF THE INVENTION

This invention relates to secretarial posture chairs, and more particularly, to a backrest height adjustment mechanism for such chairs.

A secretarial posture chair generally includes a backrest portion secured to the seat and legs of the chair by a vertically oriented upright post. The backrest portion of such chairs is dimensioned so as to support the small of the back of a person sitting in the chair. In early versions, the backrest for such chairs was fixedly secured to its upright support. In order to permit the chair to be usable by different persons, latter versions of such posture chairs included vertically adjustable backrests. An example of such an arrangement is found in U.S. Pat. No. 3,295,888 to Larry L. Poland, entitled BACKREST HEIGHT ADJUSTING APPARATUS FOR CHAIRS AND THE LIKE, issued Jan. 3, 1967. This patent discloses a backrest arrangement wherein the adjusting mechanism is wholly enclosed within the upholstered back portion of the chair. The adjusting apparatus permits the backrest to be stepwise adjusted in a vertical direction relative to the vertical support posts. However, the backrest does not pivot along its horizontal axis relative to the vertical support post. As a result, as the backrest is adjusted to fit different people using the chair, the top edge of the backrest will uncomfortably impinge on the user's back. Chairs are known employing an external, clearly visible mechanism which permits limited pivotal movement along the horizontal axis of the backrest. Such a mechanism is unsightly and does not adapt to modern furniture design. Heretofore an internal, totally enclosed, adjusting mechanism has not been available having the capability of limited, highly desirable, horizontal pivotal movement.

SUMMARY OF THE INVENTION

In accordance with the present invention, an improved backrest height adjusting apparatus of the totally enclosed type is provided by which the backrest of a secretarial posture chair may be stepwise, vertically adjusted along the vertical post of the chair and also capable of limited, pivotal movement along its horizontal axis. Essentially, the height adjusting mechanism includes a channel shaped support plate adapted to be fixedly secured within a slot formed in the backrest of the chair. A housing having an elongated slot in a face thereof is adapted to receive the vertical support post of the chair. The vertical support post includes a stud like element mounted on one face thereof which is adapted to ride within the elongated slot. A latching mechanism is pivotally supported on the housing and cooperates with the stud to provide vertical, stepwise adjustment. The housing is operatively connected to the support plate by a resilient arrangement which permits limited pivotal movement of the support plate along the horizontal axis of the mechanism. In one embodiment, the housing is secured to the support plate by a pair of bolts which pass through a pair of resilient blocks. In another embodiment, a spring assembly including a spring support plate and a leaf spring is disposed between the housing and the support plate. A pivot pin passes transversely through the support plate, the spring support plate, and the housing to pivotally interconnect the elements.

Among the objects of the present invention, therefore are: the provision of a totally enclosed, backrest height adjusting apparatus for secretarial posture chairs and the like; the provision of a backrest height adjusting apparatus having the capability of stepwise, vertical adjustment relative to a vertical support post of a chair; the provision of a backrest height adjusting apparatus capable of vertical adjustment and also of limited pivotal movement along the horizontal axis of the apparatus; the provision of a backrest adjusting mechanism which is extremely simple and easy to operate and yet which has a positive latching action preventing any undesired slipping of the backrest from the height which has been selected; the provision of a backrest adjusting mechanism which is totally enclosed and of simple and rugged construction; and the provision of a backrest height adjusting mechanism of the type referred to by which the problems heretofore experienced are substantially alleviated.

DETAILED DESCRIPTION OF THE PREFERRED EMBODIMENT

Figure 1:
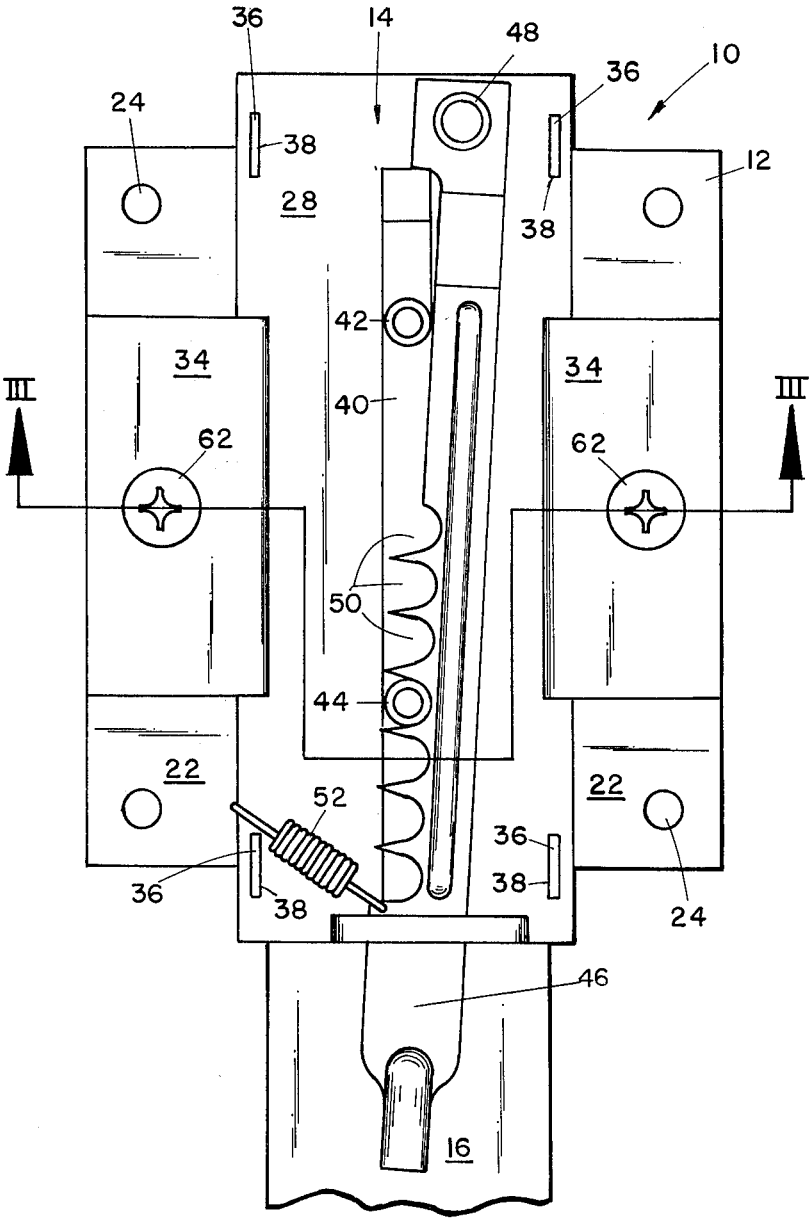
FIG. 1 is a front elevational view of one form of the height adjustment mechanism of the present invention.
Figure 2:
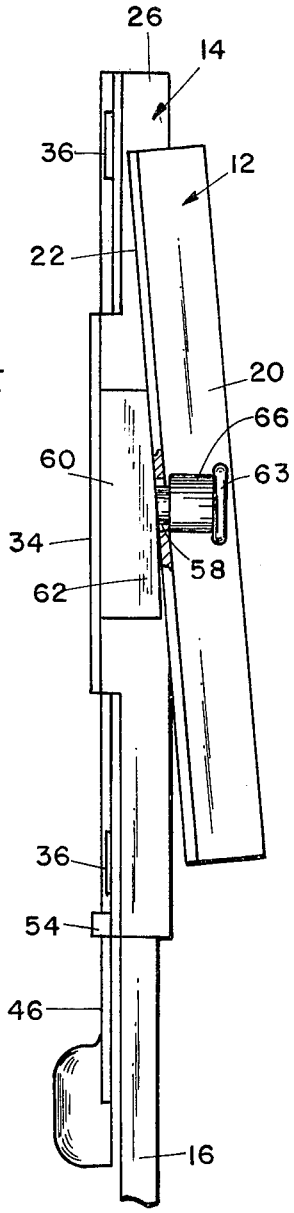
FIG. 2 is a side elevational view in partial cross section of the height adjusting mechanism of FIG. 1.
Figure 3:
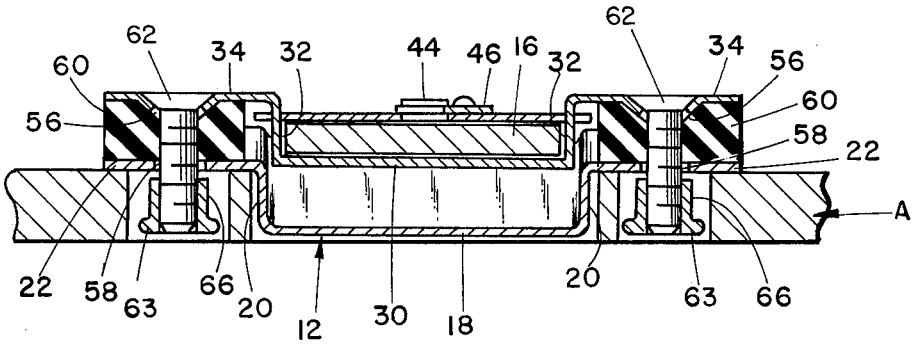
FIG. 3 is a cross-sectional view taken along line III—III of FIG. 1.

One embodiment of the present invention is illustrated in FIGS. 1–3 and generally designated 10. As shown, this embodiment of the backrest height adjusting apparatus includes a support plate 12 and a housing 14 within which is slidably disposed the upper portion of a vertical support post 16. The vertical support post is attached to the back side of a chair seat (not shown). The support plate 12 as best seen in FIGS. 2 and 3 has a generally channel shaped cross section including a base portion 18, sides 20, and outwardly extending flanges 22. The flanges are formed with a plurality of apertures 24. The support plate is secured within a vertical slot formed in a backrest A (FIG. 3) by fasteners extending through these apertures.

The housing 14 includes a channel shaped member 26 and a cover plate 28. The channel member 26 includes a base 30 and sides 32. Intermediate the ends of the channel member are formed a pair of outwardly extending connecting flanges 34. The channel member 26 further includes a plurality of upright tabs 36. The tabs 36 cooperate with apertures 38 formed in the cover plate 28 to secure the cover plate to the support member 12.

The cover plate 28 is formed with a longitudinally extending slot 40. The vertical support post 16 includes two spaced studs 42 and 44 weldably secured or formed integral with the support post 16 at spaced positions along its longitudinal center line. The studs 42 and 44 are dimensioned so as to fit and ride within the confines of the slot 40 and thus maintain the alignment of post 16 within the channel of housing 14.

A latch mechanism is provided to positively lock and position the housing 14 on the vertical support post 16. The latch mechanism includes a lever 46 pivotally connected at one end 48 (FIG. 1) to the cover plate 28 of the housing 14. The lever or latch bar 46 includes a series of spaced recesses 50 formed in the surface thereof along one lateral edge. The recesses 50 are dimensioned so as to receive the circular stud 44. A spring 52 is connected between the latch bar 46 and the cover plate 28 to bias the latch bar against the stud 44. As best seen in FIGS. 1 and 2, the cover plate 28 is formed at its lower end with an outwardly extending strap 54 defining an opening through which the latch bar lever 46 extends. The strap 54 provides a guide for the latch bar 46 and also limits the pivotal movement under the bias of the spring 52 when the vertical support post 16 is not present within the housing 14. The stud 42 limits the downward vertical movement of the overall assembly 10 and also assists in retaining the vertical orientation of the housing 14 as it is moved on the support post 16.

The housing 14 and the support plate 12 are interconnected for limited pivotal movement so that the backrest within which the mechanism is disposed may conform to the back of the user of the chair. As shown in FIGS. 1 and 3, the connecting flanges 34 formed as part of the channel member 26 of the housing have apertures 56 formed therein. A pair of apertures 58 are formed in the outwardly extending flange portions 22 of the support plate 12 (FIGS. 2 and 3). A pair of resilient blocks 60 are disposed between the connecting flanges 34 and the flanges 22 of the support plate 12. A pair of bolts 62 are inserted through the apertures 56 and 58 and the resilient blocks 60 to interconnect the housing 14 and the support plate 12. A pair of nuts 63 are threadably secured to the lower threaded portions of the bolts 62. As best seen in FIG. 2, the slots or apertures 58 formed in the support plate flanges 22 have a diameter slightly greater than the diameter of the bolts 62. This designed in clearance provides a sufficient amount of slop to permit the support plate 12 to pivot about a horizontal axis passing through the bolts 62. The nuts 63 include an elongated, internally threaded hub portion 66 serving to limit the movement of the support plate 12 along the bolts 62 relative to the connecting flanges 34. The designed-in clearance described above permit adequate, limited pivoting of the support plate 12 relative to the vertical posts 16 so that the backrest may assume a position comfortable to the person using the chair. The resilient blocks 60 limit the pivotal movement and also bias the support plate 12 to a vertical position.

When it is desired to adjust the height of the backrest member, all that is required is to manually move the latch bar 46 against the bias of the spring 52 so that the stud 44 is no longer locked within one of the grooves or recesses 50. The backrest is then moved upwardly or downwardly to the proper position. The latch bar 46 is released again locking the stud 44 within one of the recesses 50.

Figure 4:
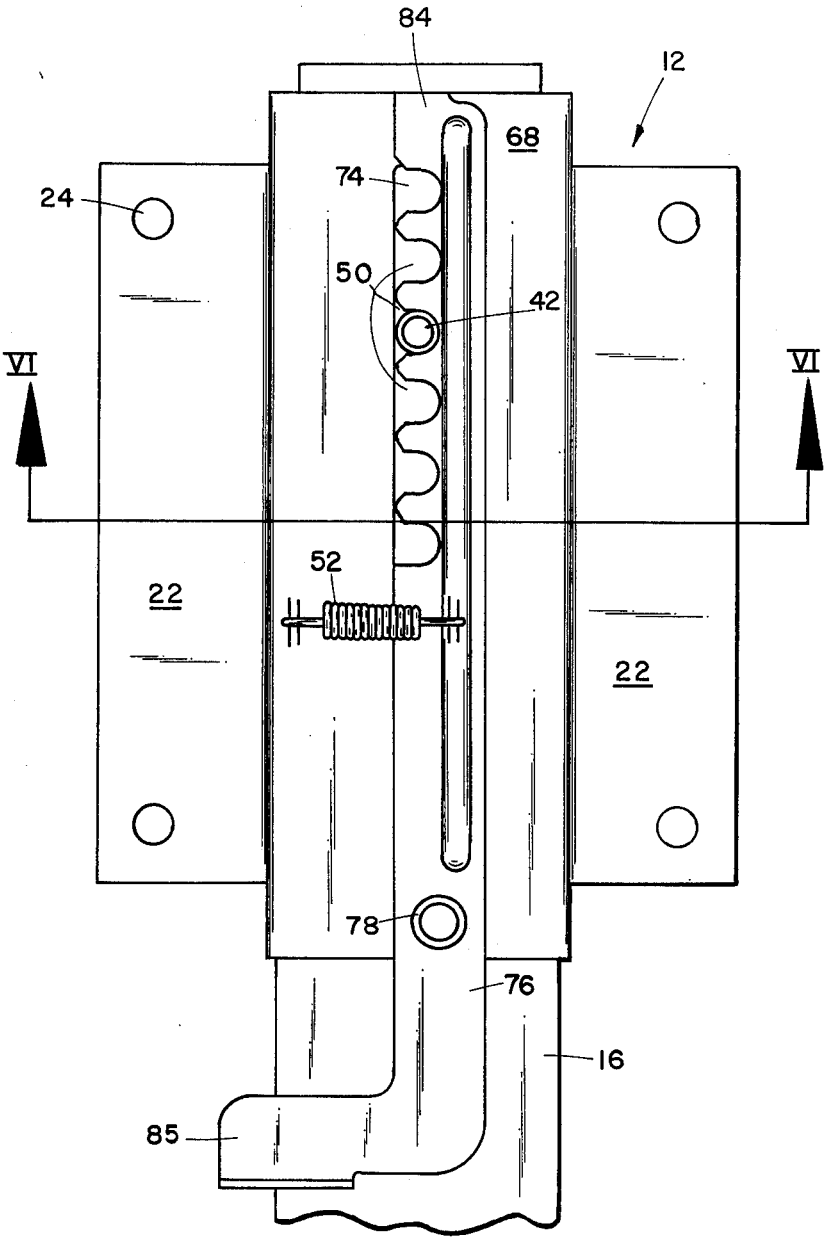
FIG. 4 is a front elevational view of another form of height adjustment apparatus in accordance with the present invention.
Figure 5:
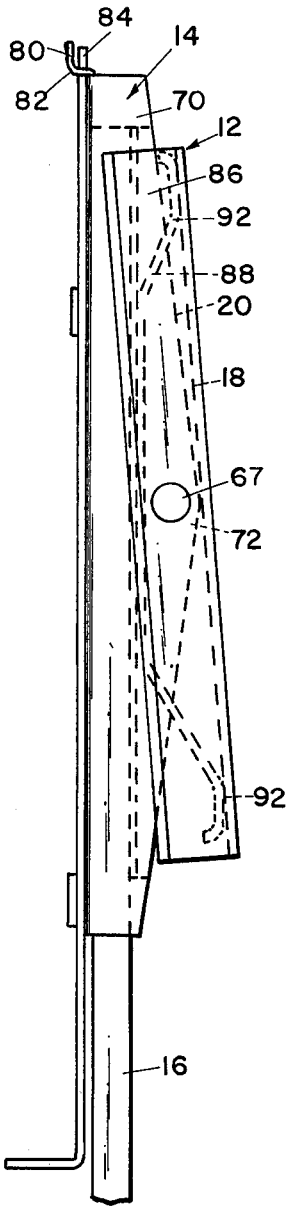
FIG. 5 is a side elevational view of the apparatus of FIG. 4.
Figure 6:
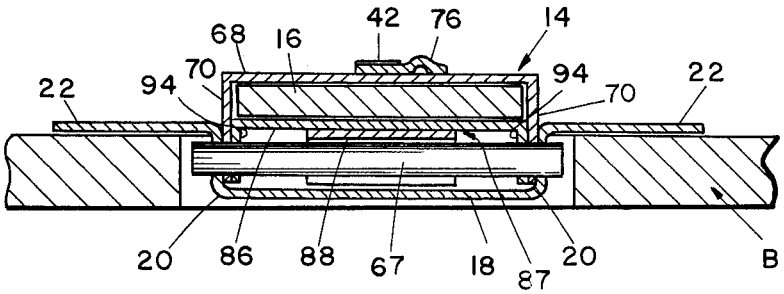
FIG. 6 is a cross-sectional view taken along line VI—VI of FIG. 4.

Another embodiment of the present invention is illustrated in FIGS. 4–9 wherein like numerals designate like parts illustrated in FIGS. 1–3. As shown, this embodiment of the height adjusting apparatus includes a support plate 12 having a generally channel shaped cross section including a base 18, sides 20 and outwardly extending mounting flanges 22. The mounting flanges 22 are likewise formed with apertures 24 serving as attachment points to a backrest B (FIG. 6). A housing 14 is pivotally connected to the support plate 12 by a pivot pin 67. In this embodiment, the housing 14 is a single piece member having a base or cover portion 68 and depending sides 70. As seen in FIG. 5, the sides 70 are generally triangularly shaped terminating in an apex point 72. The housing 14 is formed with an elongated slot 74 extending longitudinally along the cover portion 68. A latch bar 76 is pivotally connected or supported on the housing 14 at a pivot points 78. As best seen in FIGS. 4 and 5, a generally Z-shaped tab 80 is formed along the upper edge of the housing 14. The Z-shaped tab includes a slot 82 within which one end 84 of the latch bar 76 is guided.

The latch bar 76 is biased in a counterclockwise direction relative to the pivot point 78 by a spring 52 attached at one end of the latch bar and at the other end to the housing 14. The latch bar 76 includes a vertically aligned series of spaced recesses 50 formed in the surface thereof along one lateral edge. The recesses 50 cooperate with a single stud 42 disposed or formed near the upper portion of the vertical support post 16 along the longitudinal center line of the post. The latch bar 76 also includes at its lower portion an outwardly extending tab 85. By exerting an upward force on the tab 85, the latch bar 76 will pivot in a clockwise direction around the pivot point 78 permitting vertical adjustment of the housing 14 and support plate 12 relative to the vertical support post 16.

Figure 9:
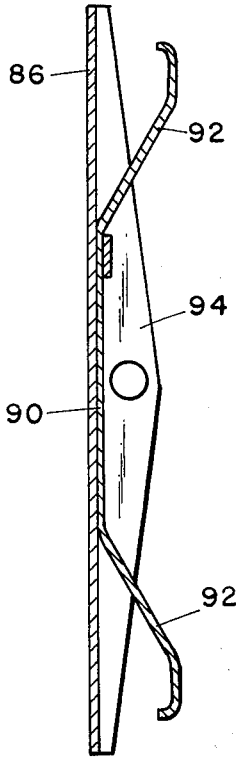
FIG. 9 is a cross-sectional view taken along line IX—IX of FIG. 7.

As best seen in FIGS. 5 and 6, the resilient arrangement which serves to limit the pivotal motion and bias the support plate 12 to a vertical position includes a leaf spring assembly 87. The assembly 87 includes a channel shaped spring support plate 86. A leaf spring 88 having a generally flattened U-shape is secured to the spring support plate 86. The leaf spring 88, as best seen in FIG. 9, includes a base portion 90 and leg portions 92. The base portion 90 is secured to the spring support plate 86 and the leg portions 92 bear against the inner surface of the base 18 of the support plate 12.

As shown in FIG. 6, the spring support plate 86 is disposed within the housing 14 and secured thereto by the pivot pin 67. The pivot pin 67 extends through generally triangularly shaped sides 94 of the support plate 86.

Figure 8:
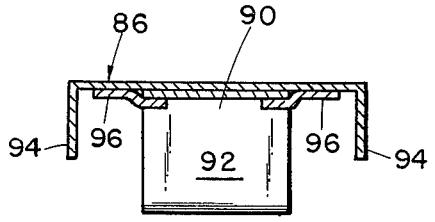
FIG. 8 is a cross-sectional view taken along line VIII—VIII of FIG. 7.
Figure 7:
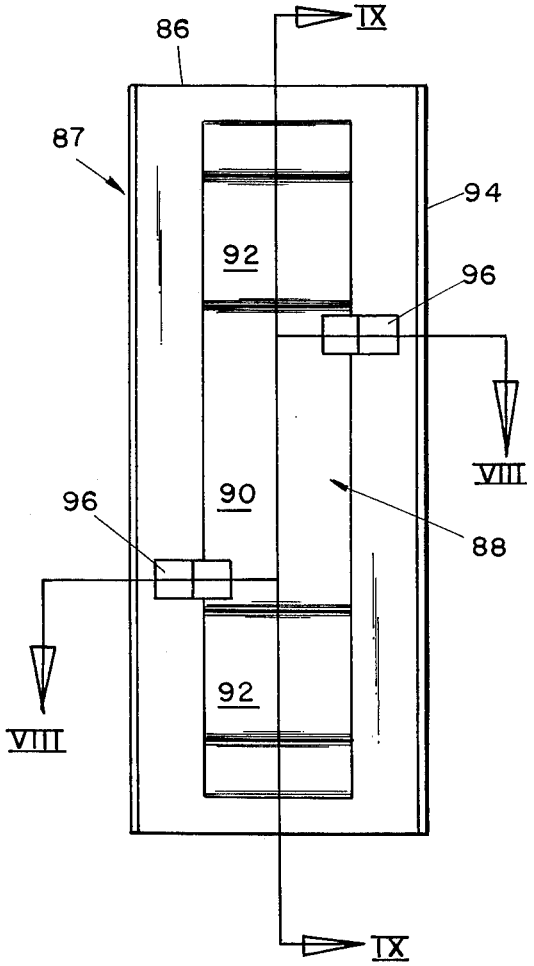
FIG. 7 is a plan view of a spring assembly employed with the apparatus of FIGS. 4–6.

As best seen in FIGS. 7, 8, and 9, the spring assembly 87 includes a pair of oppositely positioned, longitudinally spaced generally Z-shaped tabs 96. The tabs are dimensioned and positioned so that they will removably receive and retain the leaf spring 88 (FIG. 7). This feature permits the leaf spring 88 to be readily assembled to the plate 86. Further, this arrangement permits ready replacement of a particular spring with one having a greater or lesser spring rate. Therefore, the biasing arrangement of this embodiment permits ready tailoring of the resistance to pivotal movement imposed on the person using the chair by simple replacement of the leaf spring.

As best seen in FIG. 6, the housing 14 of the present embodiment cooperates with the spring support plate 86 to define a tunnel within which the post 16 is telescopically received. The sides 70 of the housing 14 and the sides 94 of the spring support plate 86 are dimensioned so that when they are interconnected by the pivot pin 67 a slip fit with the post 16 is provided.

The triangular shaped sides 70 and 94 of the housing 14 and the spring support plate 86, respectively, serve as stop surfaces against which the base 18 of the support plate 12 abuts to limit pivotal movement.

The operation of the embodiment shown in FIGS. 4–9, is basically the same as with the first form of the invention. The latch bar 76 is manually pivoted against the bias of the spring 52 thereby unlatching from the stud 42. The backrest and support plate 12 may then be moved upwardly or downwardly to the proper position on the post 16 and again locked in place by the latching mechanism.

The spring assembly 87 permits limited pivotal movement so that the backrest will conform to the person using the posture chair.

It is therefore readily apparent that the present invention provides a totally enclosable, adjustable backrest assembly capable of permitting vertical, stepwise adjustment of a backrest and limited pivotal movement along its horizontal axis so that the chair may be readily adaptable to persons of different heights. Both embodiments are extremely simple and easy to operate and yet provide positive locking action preventing any undesired slipping of the backrest from the height which has been selected. The adjusting mechanism is rugged, mechanically simple and relatively easily manufactured. As expressly intended, therefore, the foregoing description is illustrative of the preferred embodiment only and is not to be considered limiting. The true spirit and scope of the present invention will be determined by reference to the appended claims.

The embodiments of the invention in which an exclusive property or privilege is claimed are defined as follows.

1. A backrest height adjustment apparatus for chairs of the type including a vertical support post and a back having a vertical slot therein, comprising:

a support plate having a generally channel shaped cross section including a base and spaced sides and further including means for mounting said support plate to the chair back within said vertical slot;

a housing slidably receiving said vertical support post of the chair, said housing disposed between said sides of said support plate and including a channel shaped housing plate having spaced side portions;

latching means including a first member supported by said housing and a second member supported by said post for permitting stepwise, vertical adjustment of the housing and support plate relative to the vertical support post, one of said members being a pivotally mounted latch bar having a series of spaced recesses formed in the surface thereof along one lateral edge, the other of said members being a stud receivable within one of said spaced recesses:

means engaging said latch bar for biasing said latch bar against said stud; and resilient means interconnecting said housing and said support plate for biasing said support plate to a vertical position and for permitting limited pivotal movement of said support plate relative to said housing.

2. A backrest height adjustment apparatus as defined by claim 1 wherein said housing further comprises:

a pair of outwardly extending connecting flanges located intermediate the ends of said side portions.

3. A backrest height adjustment apparatus as defined by claim 2 wherein said housing further includes:

a cover plate secured to said housing plate and having a longitudinal slot formed therein; and wherein said latch bar is pivotally connected at one end to said cover plate, and said stud is integral with the vertical support post and slidable within the longitudinal slot.

4. A backrest height adjustment apparatus as defined by claim 2 wherein said resilient means comprises:

at least a pair of resilient blocks, one of said blocks being disposed between each of said connecting flanges and said mounting flanges of said support plate, said mounting flanges and said connecting flanges having at least two sets of aligned apertures formed therein; and at least a pair of bolts, one of said bolts passing through one set of said apertures and through one of said resilient blocks, said apertures formed in said support mounting flanges having a diameter greater than the bolt diameter; and a plurality of nuts which are threadably disposed on each of said bolts, said nuts having a hub portion adapted to set the clearance between said connecting flanges and said mounting flanges.

5. A backrest height adjustment apparatus as defined by claim 4 wherein said cover plate further includes an outwardly extending strap defining an opening through which the latch bar extends.

6. A backrest height adjustment apparatus as defined by claim 1 wherein said housing further comprises:

a cover portion extending between said side portions, said side portions being generally triangular in shape and extending in the direction of said support plate, the lateral edges of said side portions dimensioned to abut said support plate to limit pivotal movement of said support plate relative to said support post.

7. A backrest height adjustment apparatus for chairs of the type including a vertical support post, comprising:

a support plate including means for mounting said support plate to a chair back;

a housing adapted to slide on the vertical support post of the chair;

latching means supported by said housing for permitting stepwise, vertical adjustment of the housing and support plate relative to the vertical support post;

resilient means interconnecting said housing and said support plate for biasing said support plate to a vertical position and for permitting limited pivotal movement of said support plate relative to said housing, said housing comprising:

a channel shaped housing plate having a cover portion and side portions, said side portions being generally triangular in shape and extending in the direction of said support plate wherein said cover portion of said channel shaped housing plate includes an elongated longitudinally extending slot adapted to receive a stud disposed on the vertical support plate; and said latching mechanism includes a latch bar pivotally connected to said cover portion adjacent one end thereof, said cover portion having a Z-shaped tab with a slot formed therein at the opposite end thereof within which one end of the latch bar rides.

8. A backrest height adjustment apparatus as defined by claim 7, said latch bar having a series of spaced recesses formed in the surface thereof along one lateral edge, said recesses adapted to receive the stud of the vertical support post; and further including spring means connected between said latch bar and said cover portion for biasing said latch bar against the stud.

9. A backrest height adjustment apparatus as defined by claim 6 wherein said resilient means comprises:

a channel shaped spring support plate having generally triangular shaped sides and dimensioned to be received within said housing to define a vertical support post receiving tunnel with said housing;

a spring removably carried by said spring support plate and bearing against said base of said support plate at longitudinally spaced points; and a pivot pin extending transversely through the sides of said support plate, said housing and said spring support plate.

10. A backrest height adjustment apparatus for chairs of the type including a vertical support post, comprising:

a support plate including means for mounting said support plate to a chair back;

a housing adapted to slide on the vertical support post of the chair;

latching means supported by said housing for permitting stepwise, vertical adjustment of the housing and support plate relative to the vertical support post;

resilient means interconnecting said housing and said support plate for biasing said support plate to a vertical position and for permitting limited pivotal movement of said support plate relative to said housing, said housing comprising:

a channel shaped housing plate having a cover portion and side portions, said side portions being generally triangular in shape and extending in the direction of said support plate, said resilient means comprises:

a channel shaped spring support plate having generally triangular shaped sides and dimensioned to be received within said housing to define a vertical support post receiving tunnel;

a spring removably carried by said spring support plate and bearing against said support plate at longitudinally spaced points;

a pivot pin extending transversely through the sides of said support plate, said housing and said spring support plate; and wherein said cover of said channel shaped housing plate includes an elongated longitudinally extending slot adapted to receive a stud disposed on the vertical support plate; and said latching mechanism includes a latch bar pivotally connected to said cover portion adjacent one end thereof, said cover portion having a Z-shaped tab with a slot formed therein at the opposite end thereof within which one end of the latch bar rides.

11. A backrest height adjustment apparatus as defined by claim 10, said latch bar having a series of spaced recesses formed in the surface thereof along one lateral edge, said recesses adapted to receive the stud of the vertical support post; and further including spring means connected between said latch bar and said cover portion for biasing said latch bar against the stud.

12. A backrest height adjustment apparatus as defined by claim 11 wherein said spring is a leaf spring having a generally flattened U-shaped configuration the legs of which bear against the support plate.

13. A backrest height adjustment apparatus as defined by claim 12 wherein said spring support plate further includes a pair of oppositely disposed longitudinally spaced tabs adapted to removably retain said leaf spring to said spring support plate.

14. A backrest height adjustment apparatus for chairs of the type including a vertical support post, comprising A support plate having a generally channel shaped cross-section including a retangular base portion and spaced side portions extending at an angle from said base portion, and including means for mounting said support plate to a chair back;

A housing secured to the vertical support post of the chair, said housing being a generally channel shaped plate having a base portion and spaced side portions extending at an angle from said base portion, the distance between said housing spaced side portions being less than the distance between said support plate side portion, said housing side portions being disposed between said support plate side portions substantially throughout the length of said housing and said housing being spaced from said support plate base portion whereby said housing and support plate can be pivotally moved relative to one another within the space between said support plate side portions; and resilient means interconnecting said housing and said support plate for biasing said support plate to a vertical position and for permitting limited pivotal movement of said support plate relative to said housing.

15. A backrest height adjustment apparatus as defined by claim 14 wherein said housing further comprises:

a pair of outwardly extending connecting flanges located intermediate the ends of said side portions.

16. A backrest height adjustment apparatus as defined by claim 15 wherein said resilient means comprises:

at least a pair of resilient blocks, one of said blocks being disposed between each of said connecting flanges and said mounting flanges of said support plate, said mounting flanges and said connecting flanges having at least two sets of aligned apertures formed therein; and at least a pair of bolts, one of said bolts passing through one set of said apertures and through one of said resilient blocks, said apertures formed in said support mounting flanges having a diameter greater than the bolt diameter; and a plurality of nuts which are threadably disposed on each of said bolts, said nuts having a hub portion adapted to set the clearance between said connecting flanges and said mounting flanges.

17. A backrest height adjustment apparatus as defined by claim 14 wherein said housing further comprises:

said side portions being generally triangular in shape and extending in the direction of said support plate, said resilient means including a channel shaped spring support plate having generally triangular shaped sides and dimensioned to be received within said housing to define a vertical support post receiving tunnel with said housing;

a spring removably carried by said spring support plate and bearing against said support plate at longitudinally spaced points; and a pivot pin extending transversely through the sides of said support plate, said housing and said spring support plate, said triangular sides of said housing and said spring support plate positioned to abut said base portion of said support plate to thereby limit pivotal movement of said support plate relative to said vertical support post.

18. A backrest height adjustment apparatus for chairs of the type including a vertical support post, comprising:

a support plate having means for mounting said support plate to a chair back;

a housing secured to the vertical support post of the chair;

resilient means interconnecting said housing and said support plate for biasing said support plate to a vertical position and for permitting limited pivotal movement of said support plate relative to said housing, said housing comprising:

a channel shaped housing plate having a cover portion and side portions, said side portions being generally triangular in shape and extending in the direction of said support plate, said resilient means comprising:

a channel shaped spring support plate having generally triangular shaped sides and dimensioned to be received within said housing to define a vertical support post receiving tunnel;

a spring removably carried by said spring support plate and bearing against said support plate at longitudinally spaced points;

a pivot pin extending transversely through the sides of said support plate, said housing and said spring support plate; and wherein said spring is a leaf spring having a generally flattened U-shaped configuration the legs of which bear against the support plate.

19. A backrest height adjustment apparatus as defined by claim 8 wherein said spring support plate further includes a pair of oppositely disposed longitudinally spaced tabs adapted to removably retain said leaf spring to said spring support plate.

20. A backrest height adjustment apparatus for chairs of the type including a vertical support post, comprising:

a housing slidably mounted on the vertical support post of the chair and means for mounting said housing on a chair back; and latching means including a first member supported by said housing and a second member supported by said post for permitting stepwise, vertical adjustment of the housing relative to the vertical support post, one of said members being a pivotally mounted latch bar, said latch bar having a series of spaced recesses formed in the surface thereof along one lateral edge, the other of said members being a stud receivable in one of said recesses; and means connected between the latch bar and the housing for biasing the latch bar against the stud.

21. A backrest height adjustment apparatus as defined by claim 20 wherein said biasing means is a coil spring.

* * * * *

UNITED STATES PATENT AND TRADEMARK OFFICE

CERTIFICATE OF CORRECTION

PATENT NO. : 4,043,592

DATED : August 23, 1977

INVENTOR(S) : Bernard J. Fries

It is certified that error appears in the above-identified patent and that said Letters Patent are hereby corrected as shown below:

Column 4, line 14:
"points" should be --point--

Column 10, line 8, claim 19:
"8" should be --18--

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*